US010323403B1

(12) United States Patent
Stapleton et al.

(10) Patent No.: US 10,323,403 B1
(45) Date of Patent: Jun. 18, 2019

(54) ACOUSTIC SHELL FOR STAGE PERFORMANCES

(71) Applicant: CS Inventions, LLC, Nashville, TN (US)

(72) Inventors: Christopher A Stapleton, Nashville, TN (US); Michael Cronin, Nashville, TN (US); Bruce Rodgers, Salem, CT (US); Tye Trussell, Franklin, TN (US); James McKinney, Spring Hill, TN (US); John Garriott, Portland, TN (US); Clayton Hunt, Whites Creek, TN (US); Matt Jumper, Hendersonville, TN (US)

(73) Assignee: CS INVENTIONS, LLC, Nashville, TN (US)

( * ) Notice: Subject to any disclaimer, the term of this patent is extended or adjusted under 35 U.S.C. 154(b) by 0 days.

(21) Appl. No.: 15/879,145

(22) Filed: Jan. 24, 2018

(51) Int. Cl.

| | |
|---|---|
| ***E04B 1/34*** | (2006.01) |
| ***G10K 11/16*** | (2006.01) |
| ***E04B 1/32*** | (2006.01) |
| ***E04H 3/22*** | (2006.01) |
| ***E04B 1/99*** | (2006.01) |
| ***E04B 1/82*** | (2006.01) |
| ***E04B 1/343*** | (2006.01) |

(Continued)

(52) U.S. Cl.
CPC ..... *E04B 1/34321* (2013.01); *E04B 1/3211* (2013.01); *E04B 1/34326* (2013.01); *E04B 1/99* (2013.01); *E04H 3/22* (2013.01); *G10K 11/162* (2013.01); *E04B 1/8209* (2013.01); *E04B 2001/0053* (2013.01); *E04B 2001/327* (2013.01)

(58) Field of Classification Search
CPC ..... E04B 1/34321; E04B 1/3211; E04B 1/34326; E04B 1/99; E04B 2002/0052; E04B 2001/327; E04B 1/8209; E04H 3/22; G10K 11/162
See application file for complete search history.

(56) References Cited

U.S. PATENT DOCUMENTS 2,674,335 A * 4/1954 Lemmerman ..... B64F 1/26 181/217
4,227,047 A * 10/1980 Horne ..... H04R 5/02 381/182

(Continued)

FOREIGN PATENT DOCUMENTS

JP 03109098 A * 5/1991
JP 2009185590 A * 8/2009

*Primary Examiner* — Jeanette E Chapman
(74) *Attorney, Agent, or Firm* — Notaro, Michalos & Zaccaria P.C.

(57) ABSTRACT

An acoustic shell for stage performances has a frame defining a concave volume that is curved in two orthogonal planes and has an inner surface facing forwardly of a stage for a performance. A plurality of polygonal acoustic panels are positioned in the frame and spaced in rows and column along the inner surface, each panel having an outer acoustically active surface. The frame is formed of plural curved trusses each with a base for support on the stage and a peak. An oculus ring is connected to the peak of each arch and the bases of the arches are space along a bottom curve of the concave volume. The panels comprise plural adjacent blocks in rows and columns, each with a base and inner closed end, the length of each block being different for adjacent blocks.

26 Claims, 15 Drawing Sheets

(51) Int. Cl.
*G10K 11/162* (2006.01)
*E04B 1/00* (2006.01)

(56) References Cited

U.S. PATENT DOCUMENTS

| | | | | |
|---|---|---|---|---|
| 5,027,920 | A | 7/1991 | D'Antonio | |
| 5,168,129 | A | 12/1992 | D'Antonio | |
| 5,401,921 | A | 3/1995 | D'Antonio | |
| 5,525,766 | A * | 6/1996 | Atcheson | G10K 11/20 160/135 |
| 5,724,775 | A * | 3/1998 | Zobel, Jr. | E04B 1/3211 359/443 |
| 5,927,030 | A * | 7/1999 | Petit | H02G 3/285 52/220.1 |
| 6,112,852 | A | 9/2000 | D'Antonio | |
| 6,431,312 | B1 | 8/2002 | D'Antonio | |
| 7,765,746 | B2 * | 8/2010 | Reed | E04B 1/3211 52/167.4 |
| 9,447,592 | B2 * | 9/2016 | Monacchi | E04H 3/22 |
| 2012/0073428 | A1 * | 3/2012 | Milinkovic | B28B 1/087 89/36.04 |

* cited by examiner

| | | | | | | | | | | | | |
|---|---|---|---|---|---|---|---|---|---|---|---|---|
| 4.64 | 23.36 | 12.97 | 13.36 | 8.87 | 14.26 | 11.82 | 6.69 | 12.85 | 21.56 | 7.08 | 8.36 | 6.82 |
| 18.10 | 7.21 | 20.28 | 8.62 | 10.54 | 8.23 | 15.03 | 22.97 | 17.46 | 7.97 | 11.31 | 19.38 | 5.67 |
| 12.33 | 14.13 | 20.03 | 4.90 | 6.95 | 16.56 | 5.03 | 18.87 | 18.36 | 10.92 | 23.87 | 20.41 | 20.54 |
| 6.18 | 5.41 | 14.38 | 23.74 | 8.49 | 18.74 | 6.44 | 9.13 | 17.97 | 15.41 | 18.49 | 22.85 | 5.54 |
| 11.69 | 14.90 | 11.05 | 15.67 | 22.21 | 6.31 | 17.33 | 16.18 | 9.51 | 13.49 | 20.79 | 16.05 | 17.72 |
| 12.21 | 22.33 | 18.23 | 19.13 | 22.08 | 14.51 | 15.54 | 10.28 | 4.51 | 11.44 | 11.18 | 7.46 | 24.00 |
| 23.49 | 4.77 | 15.15 | 14.77 | 19.26 | 13.87 | 16.31 | 21.44 | 15.28 | 6.56 | 21.05 | 19.77 | 21.31 |
| 10.03 | 20.92 | 7.85 | 19.51 | 17.59 | 19.90 | 13.10 | 5.15 | 10.67 | 20.15 | 16.82 | 8.74 | 22.46 |
| 15.79 | 14.00 | 8.10 | 23.23 | 21.18 | 11.56 | 23.10 | 9.26 | 9.77 | 17.21 | 4.26 | 7.72 | 7.59 |
| 21.95 | 22.72 | 13.74 | 4.38 | 19.64 | 9.38 | 21.69 | 19.00 | 10.15 | 12.72 | 9.64 | 5.28 | 22.59 |
| 16.44 | 13.23 | 17.08 | 12.46 | 5.92 | 21.82 | 10.79 | 11.95 | 18.62 | 14.64 | 7.33 | 12.08 | 10.41 |
| 15.92 | 5.79 | 9.90 | 9.00 | 6.05 | 13.62 | 12.59 | 17.85 | 23.62 | 16.69 | 16.95 | 20.67 | 4.13 |

FIG. 15

ACOUSTIC SHELL FOR STAGE PERFORMANCES

FIELD AND BACKGROUND OF THE INVENTION

The present invention relates generally to the field of acoustic structures for modifying sounds, and in particular, to a new and useful acoustic shell for stage performances that allows the performers on any stage and venue, despite its size, to hear each other and thereby permit the type of intimate personal interaction normally available only in small performance settings like small stages and clubs, while still providing good acoustic properties for the performance sounds to be heard by any sized audience in front of the stage.

Treating spaces with sound diffusion materials and arrangements for acoustic purposes is known, for example in churches and concert halls.

I problem facing large stage musical performers, however, is that the on-stage acoustic environment makes it difficult for the performers to hear each other and this environment also changes from venue to venue since the immediate surroundings change so drastically in each venue, that sonically there is no continuity.

A modular acoustic system using two foot square tiles is known by the trademark SKYLINE and is available from RPG Diffusor Systems, Inc. U.S. Pat. No. 5,401,921 for a TWO-DIMENSIONAL ROOT DIFFUSOR assigned to the same company teaches a two-dimensional primitive root diffusor that includes a two-dimensional pattern of wells, the depths of which are determined through operation of primitive root sequence theory.

U.S. Pat. No. 5,168,129 for a VARIABLE ACOUSTICS MODULAR PERFORMANCE SHELL, also assigned to RPG Diffusor Systems, Inc., teaches a performance shell which includes a plurality of modular components which may be assembled together to surround a performing entity and provide an improved acoustic environment for the performers.

A need remained, however, for an apparatus that can achieve the desired and consistent acoustic effects, for any venue, while being portable for use on various stage settings on which a live performance on tour would perform.

SUMMARY OF THE INVENTION

It is an object of the present invention to provide an acoustic shell for stage performances that allows the performers on stage to hear each other during a performance that is also generating performance sounds for the audience, that are typically extremely loud, such as song and music for the audience in front of a large stage venue, to hear and enjoy, without have a detrimental effect on what the audience hears.

Accordingly, another object of the invention is to provide an acoustic shell for stage performances in the form of a partial dome that acts as a large diffuser for absorbing reflected sounds, and which creates as close to the same sonic space as possible in every venue, despite the size and local acoustics of the venue.

Another object of the invention is to construct the shell of curved arches or trusses, each made up of separate transportable parts, and large, but also transportable panels, that create sound diffusion, which together create a large, on-stage structure, built in a way that can be disassembled and transported on a daily basis, from venue to venue, e.g., during a tour. It was discovered that this requirement is best achieved using preferably but not exclusively seven quarter circles of curved, multi-part trusses, although using more or fewer trusses is also within the scope of the invention. These trusses, arches or legs, converge toward each other at the top or peak of each arch, and are connected at a ring or oculus, also made of truss parts, that act as a central top support for the partial dome shell. An optional C-shaped upper support may also be connected to tops of some or all of the arches to provide additional support. While the term "C-shaped truss" is used in this disclosure for convenience, this term is used to also describe supports of other shapes and supports of other than truss type structures, as long as the structure, if used at all, can support the loads contemplated by this invention.

Rigging motors with cables are used to suspend the optional C-shaped support, the oculus, part of each arch and some of the panels from an upper rigging grid that is present in all modern large stage settings. This reduces the weight load on any locate spot on the stage floor from becoming too great, despite the high total weight of the shell.

Another object of the invention is to include, as part of the shell, an acoustically active, i.e., sound diffusing or absorbing, floor arrangement of discreet, thus transportable floor panels and rugs that absorbs sound reflected from above and further renders the acoustic environment consistent and repeatable, from venue to venue.

Another object of the invention is to utilize preferably three or more tiers of panels in rows between adjacent arches, the panels in the lower two rows having active acoustic properties and the panels in the top row or rows matching the lower panels in visual appearance, but being generally inactive acoustically. Twelve lower active and six, twelve or eighteen upper inactive panels are preferably used although more or fewer panels are also within the scope of the invention.

In view of the size and scale of the concert hall to arena sized stages to be equipped with the acoustic shell of the invention, another object of the invention is to utilize quadrilateral acoustic panels of about four to eight feet on a side and from about one to three feet deep.

Of the three or more rows of panels, the lower-most one is ground or stage mounted or supported on wheeled wagons that can lock to create a temporarily fixed bottom row. One row of active panels is above the lowest row to create a middle row that is either ground mounted or preferably flown from rigging motors above the lowest row, but clamped to the frame of the lowest row. The upper row or rows of visually consistent panels that complete the partial dome are clamped between adjacent arches. Each active panel in the bottom and middle row is preferably made up of one to two hundred individual hollow blocks, each preferably built of MDF (medium-density fiberboard), each block being filled with batting style insulation such as mineral wool. These blocks are of varying lengths and are combined a specific or random order to offer the most complete sound diffusion.

The upper inactive but visually consistent panels are preferably made of injection molded foam and have little or no acoustic purpose.

A still further object of the invention is to provide an acoustic shell for stage performances that comprises: a frame defining a concave volume that is curved in two orthogonal planes and has an inner surface for facing forwardly of a stage for a performance on which the frame it to be supported; a plurality of polygonal acoustic panels positioned in the frame and spaced in rows and column along the inner surface, each acoustic panel having an inner acoustically active surface area; the frame comprising a plurality curved, multi-part arches, each with a base to be supported on the stage and a peak, the bases being spaced along a bottom curve of the concave volume and each column of acoustic panels being positioned or connected between adjacent arches of the frame; and an oculus ring connected to the peaks of the arches; each acoustic panel comprising a plurality of adjacent blocks in rows and columns, each block having a base at a common outer plane and inner closed ends, the length of each block from its base to its inner closed end being different for adjacent blocks.

While the upper acoustically inactive panels are connected to their adjacent arches, the lower acoustically active panels are not mechanically connected to the arches but are just positioned between adjacent arches.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 15 is a schematic representation of an example of the lengths of the acoustic blocks of a typical acoustic panel of the invention.

DESCRIPTION OF THE PREFERRED EMBODIMENTS

Figure 1:
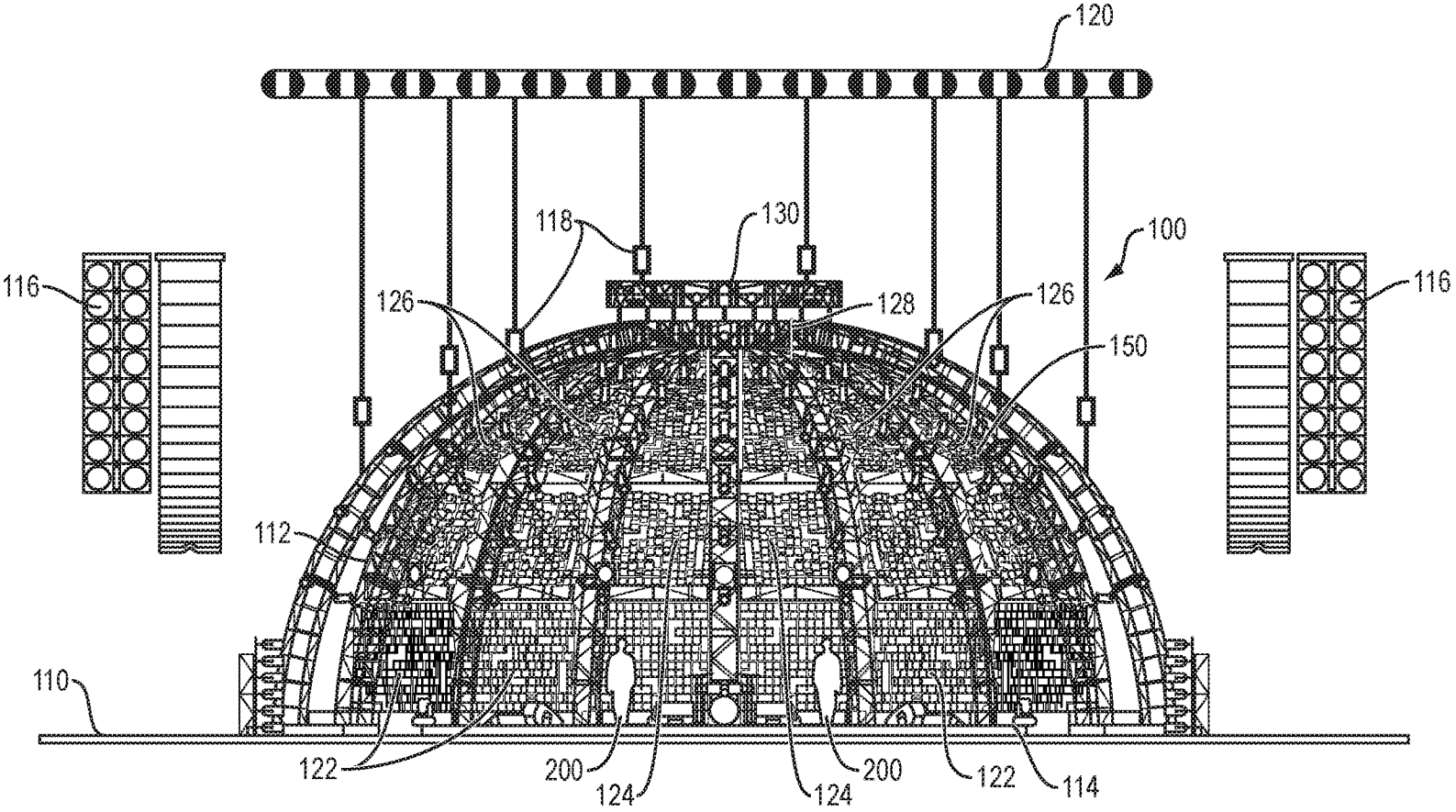
FIG. 1 is a front elevational view of an acoustic shell of the invention on a stage with a rigging grid and speakers, for a stage performance in a large venue setting.

Referring now to the drawings, in which like reference numerals are used to refer to the same or similar elements, FIG. 1 illustrates an acoustic shell 100 for stage performances such as concerts, on a stage 110 of a concert hall, theater, arena, stadium or any other large venue. The shell 100 comprises a frame 112 defining a concave, partial spherical volume that is curved in two orthogonal planes and has an inner surface facing forwardly of the stage 110, toward an audience for viewing and hearing a performance.

The frame 112 is supported on the stage 100 and the shell 100 includes a sound absorbing floor 114, which, like the frame, is of module construction and is also supported on the stage. Large powerful speakers 116 are mounded on either side of the stage for emitting the sounds of the performance, and a rigging grid 120 of known design, is fixed many feet above the stage surface. The cables of multiple rigging motors 118 are suspended from the grid 120 and are used to help erect the shell frame and acoustic panels of the invention, to support these components during a performance, and to help disassemble the frame and panels after a performance.

The shell of the invention also includes a plurality of polygonal, preferably quadrilateral acoustic panels 122 and 124, positioned in the frame 112 and spaced in rows and columns along the inner surface of the concave volume, each acoustic panel having an inner acoustically active surface area facing inwardly toward performers 200, standing on the floor 114.

The frame 112 comprises a plurality curved, multi-part arches 126, each with a base touching and at least partly supported on the stage 110, and a peak, the bases being spaced along a bottom curve of the concave volume and each column of acoustic panels being positioned between adjacent arches of the frame. An oculus or truss ring 128 is connected by strong but flexible straps to the peaks of the arches to support part of the weight of each arch, and an optional C-shaped truss 130 is connected by other strong but flexible straps to some or all of the arches near their upper ends, to support some of the weight of each arch, if necessary. The oculus and the C-shaped truss, if present, are both suspended by rigging motors 118 and their cables from the rigging grid 120.

Figure 12:
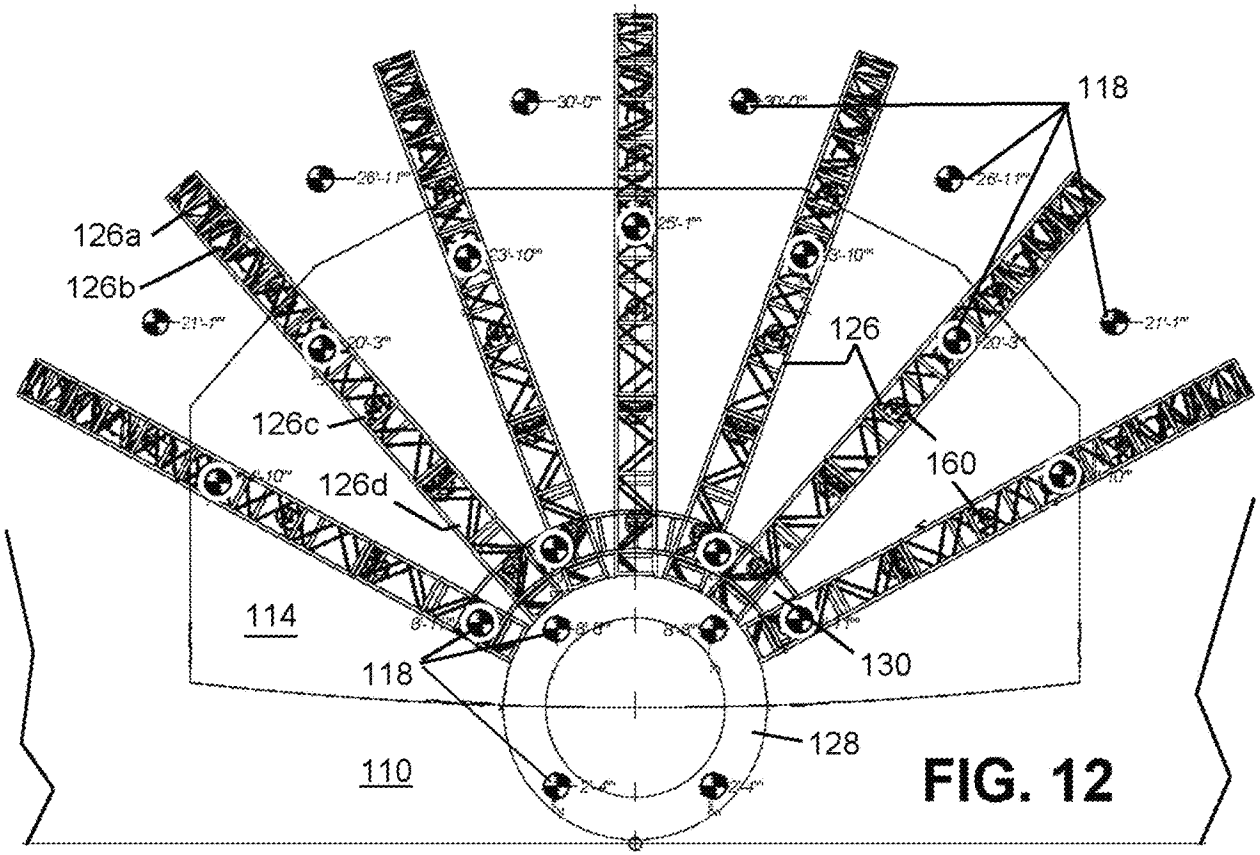
FIG. 12 is a top plan view of the frame of the shell showing the location of load points from the rigging grid of the stage and the outline of another embodiment of the sound absorbing floor of the invention.

About half way along the length of each arch 126, each arch is also suspended by a rigging motor 118 and the grid 120. This use of the oculus, the optional C-shaped truss, extra rigging motor support and some bearing down of the arch bases on the stage surface proper, distributes the considerable weight of the structure to avoid over loading any single part of the stage of rigging grid. FIG. 12 shows the arrangement of rigging motor support points on the grid above the shell of the invention.

Figure 2:
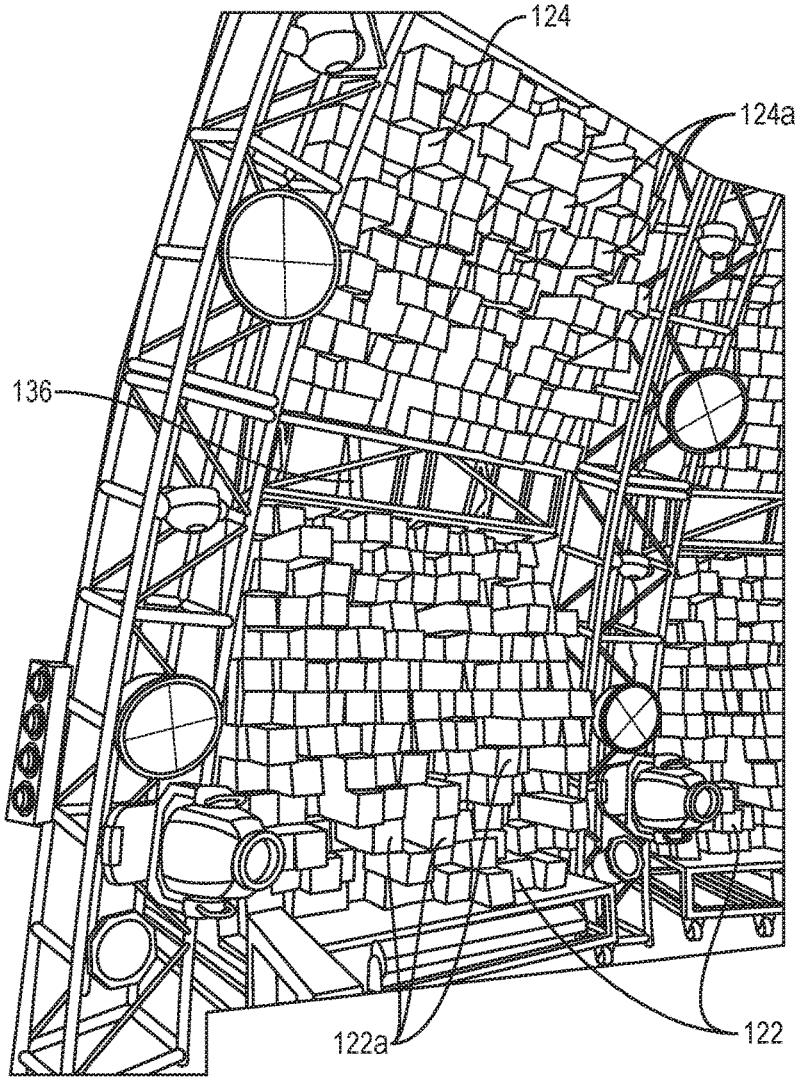
FIG. 2 is a partial front perspective view of the lowest and upper acoustic panels between the lower parts of the frame of the invention.
Figure 3:
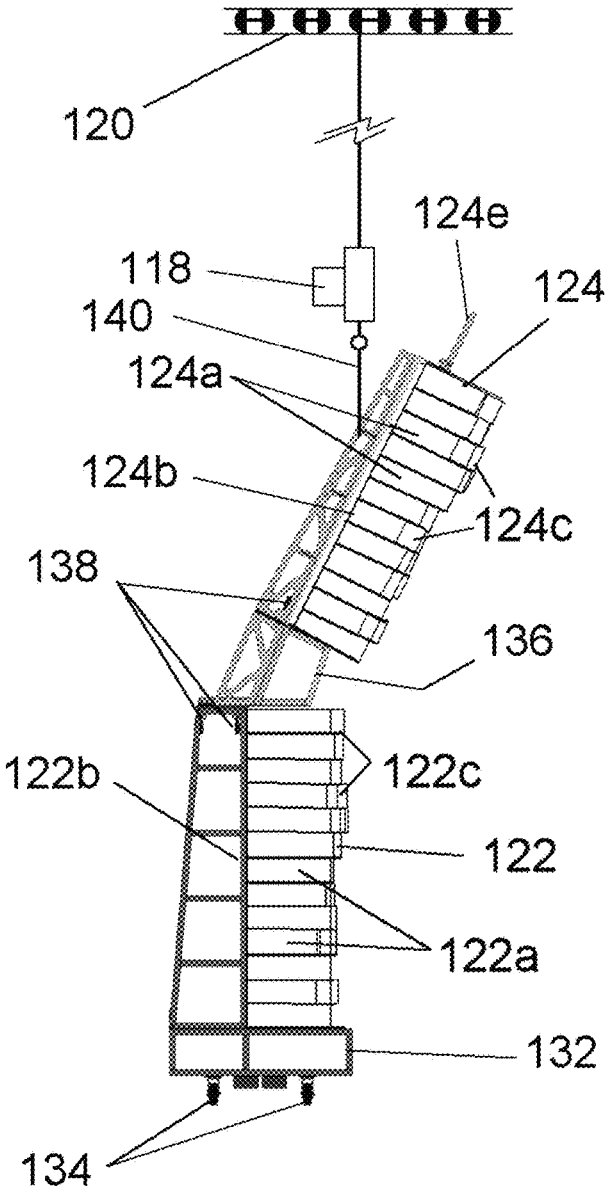
FIG. 3 is a side elevational view of the lowest and upper acoustic panels in a position for use during a performance.

As best shown in FIGS. 2 and 3, each acoustic panel 122 and 124 comprises a plurality of adjacent blocks 122*a* and 124*a* in rows and columns, each block having a base at a common outer plane 122*b* and 124*b*, and inner closed ends 122*c* and 124*c*. The length of each block from its base to its inner closed end is different for adjacent blocks to cause a random absorption and diffusion of reflected sound. This deadens the loud reflected sounds from the speakers and surrounding surfaces to allow the performers 200 to hear each other clearly. This, in turn, allows them to avoid using in-ear buds that have become common for tour performers and tends to isolate each performer. Instead, the performers can interact in a natural way, as if they are in a small club setting, for example, and bring this sense of intimacy to an arena sized venue.

This repeatable controlled acoustic environment is only practical, however, if it can be assembled, used for a performance, and disassembled into sizes that can be packaged and transported, e.g. by eighteen wheelers or other large vehicles, so as to be ready for a repeat assembly on the next day. The invention achieves this by insuring that no one part is too large or heavy to be placed on a manually rollable cart for transport, and hoisted for assembly by hand or by rigging motor.

As shown in FIG. 3, a wagon 132 with at least one lockable wheel 134 supports the lowest acoustic panel 122 in each column. A truss wedge 136 is connected by temporary fasteners such as hook and lever clamps 138 or nuts and bolts or other known temporary fasteners, to an upper end of the lowest acoustic panel. The upper acoustic panel 124, above the lowest acoustic panel in each column, is fixed to the truss wedge 136 by the same or different temporary fasteners. A rigging motor 118 is flexibly connected to the upper frame of the acoustic panel 124, for example, by a strap harness 140, and is itself suspended from the rigging grid 120, above the stage, for supporting some of the weight of the lowest and upper acoustic panels in each column.

An example of the type of rigging motors 118 that can be used with the invention is the Tour Rig 1 ton fixed speed chain motor by Liftket of Germany.

The various lengths of the rows and columns of adjacent blocks 122*a* and 124*a* of each acoustic panel 122 and 124, can be selected by following the teaching of U.S. Pat. No. 5,401,921. The 10 to 20, or preferably 15 degree angle of each closed inner ends 122*c* and 124*c* of each block 122*a* and 124*a* should also be rotated 90 or 180 degrees to the same angle of an adjacent block end, to help further diffuse sound striking the panel, and adjacent acoustic panels should have different block patterns. FIG. 15 shows a schematic example of another arrangement of the block lengths for an acoustic panel.

Medium-density fiberboard (MDF) is an engineered wood product made by breaking down wood residuals into wood fibers, combining these with wax and a resin binder and forming panels by applying high temperature and pressure. MDF is generally denser than plywood. Mineral wool is a generic name for fiber materials that are formed by spinning or drawing molten minerals or synthetic minerals such as slag and ceramics. Rock wool is a form of mineral wool made by convert molten limestone into fibers.

Figure 4:
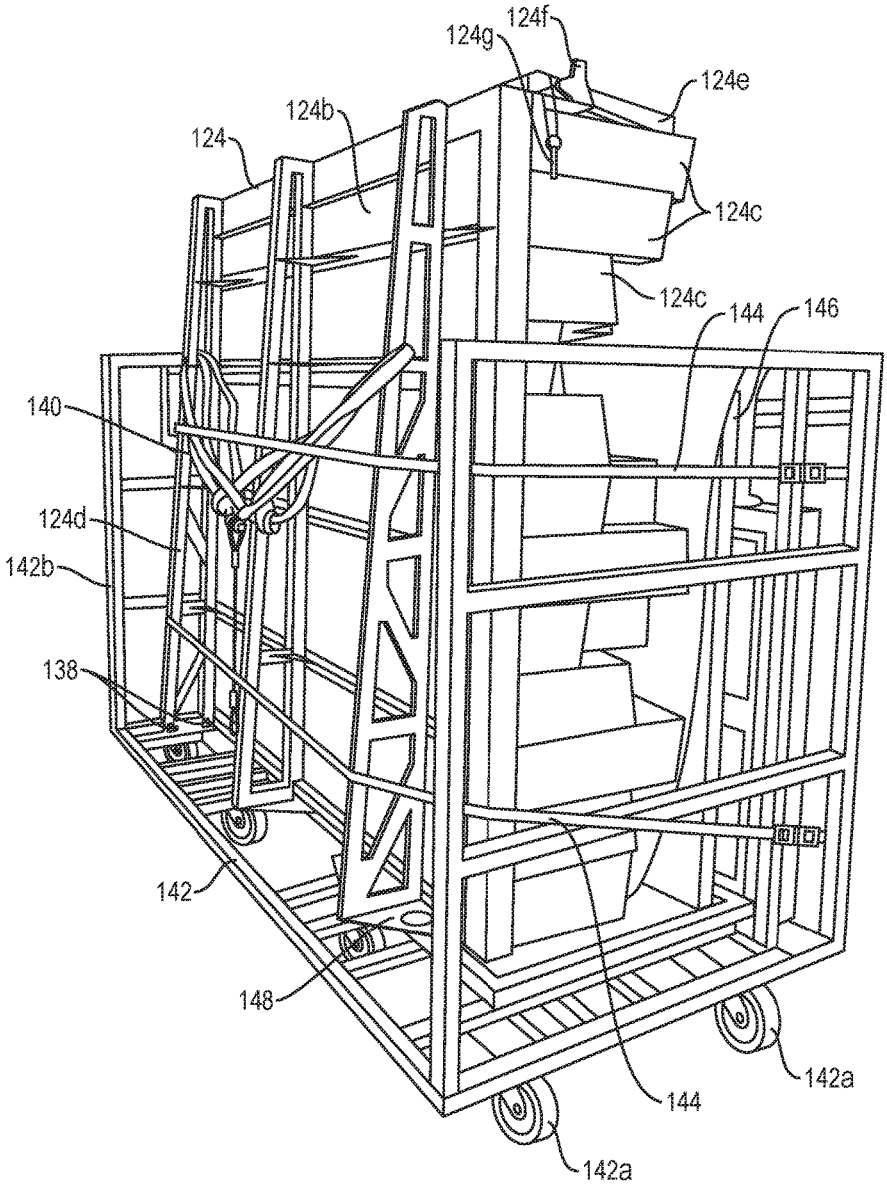
FIG. 4 is a rear perspective view of a transport cart with components of the invention including one of the upper acoustic panels and two sound tuning boards for use in covering part or all of one of the lower acoustic panels for fine tuning the acoustic properties of the shell as a whole, these components being securely strapped to the cart for transport, e.g., in an eighteen wheeler, from one venue to the next.

With reference to FIG. 4, for transport from venue to venue, or for storage between shows and between tours, and before the shell is erected and after it is disassembled, multiple wheeled carts 142 are used to securely carry one of more components of the shell. Each cart is constructed to have a frame designed to carry selected components and is of a size and weight (with the component(s) loaded) so it can be manually wheeled, using a ramp or dock, onto and off the rear opening of a conventional freight carrying land vehicle, such as an eighteen wheel tracker-trailer with a standard 53 feet long trailer and maximum 8 foot width.

In FIG. 4 one of the upper acoustic panels 124 is shown held by straps 144 to and within the frame 142*b* of the cart 142, which also have wheels 142*a*. In addition, two flat rectangular sound tuning boards 146, used to partly or wholly cover one of the lower acoustic panels for fine tuning the acoustic properties of the shell as a whole, are also carried on the same cart, to maximize cart utilization and conserve the number of carts needed. FIG. 4 also illustrates one embodiment of the lifting harness 140 of straps and loops that is attached to the frame 124*d* of the panel 124, and left in place even after the shell is disassembled. The latch clamps 138 on the panel frame 124*d* are also visible, as a non-limiting example of the type of temporary fastener that can be used to secure the upper panel to the lower panel directly or via the wedge truss 136 of FIG. 3.

Figure 6:
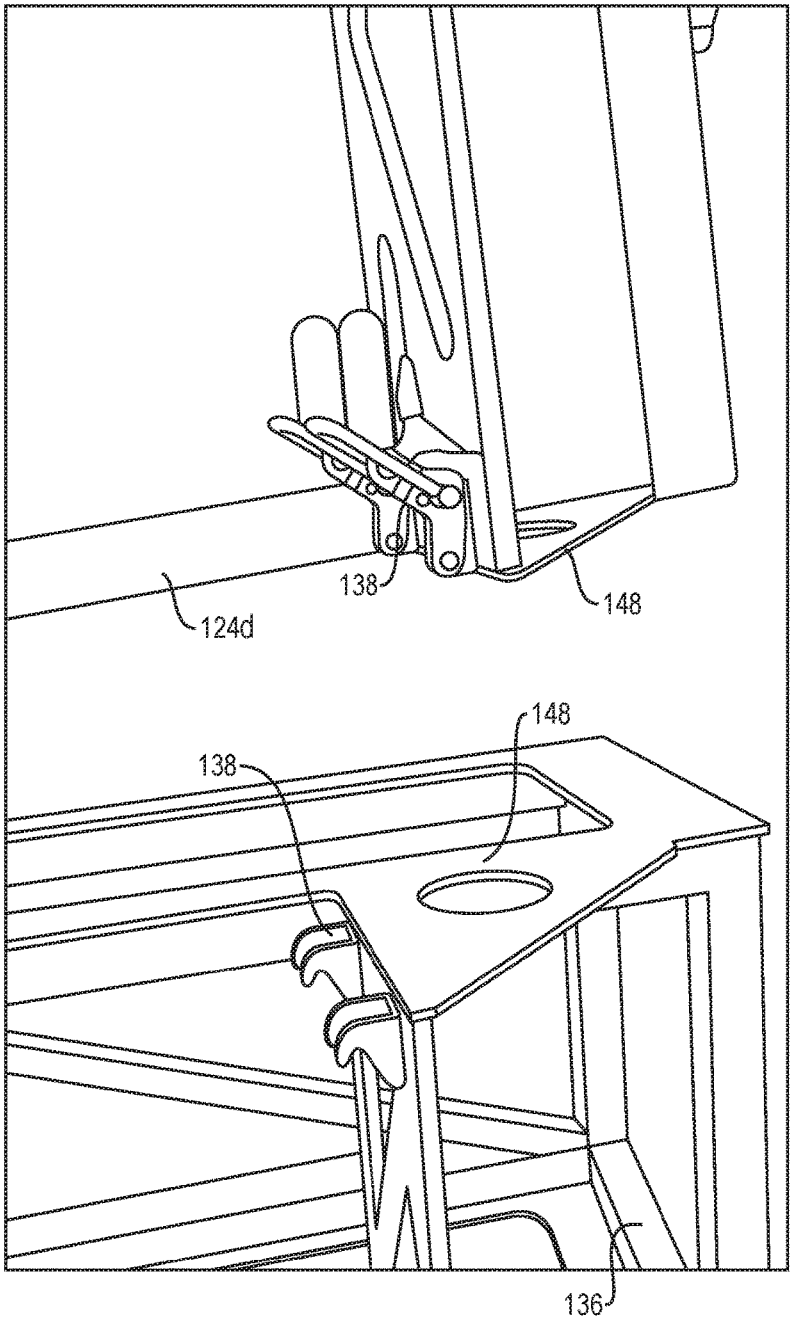
FIG. 6 is a partial perspective view of the upper panel and wedge truss of the invention.

Also visible in FIG. 4 are two gusset plates 148 each with a large circular downward projection that matches the shape of a hole in a gusset plate 148 of the wedge truss 136 that receives the projection to accurately align the upper and lower panels to each other before clamps 138 are closed to securely fix the panels to each other, for the duration of a show. FIG. 6 shows additional details.

By using a harness 140 and rigging motor 118 suspended from rigging grid 120 to lift the upper panel for assembly and, after the lower panel is connected, during the show, some of the considerable weight of the two panels 122 and 124, and their frames is transferred to the grid, thereby limiting the downward pressure of each wheel 134 of the wagon 132 on the surface of the stage and, at the same time, eliminating the need for a counter weight or rearward buttress that would otherwise be needed to keep the forwardly cantilevered acoustic panel combination from tipping forwardly, out of the frame 112.

Comparing FIGS. 3 and 4, an upper frame portion 124*e* is folded down for transport in FIG. 4. This frame portion 124*e* is rotated upwardly and held between a pair of ears 124*f* by a locking pin 124*g*, to be upright for use in FIG. 3. This frame portion 124*e* acts as a backstop for the lowest acoustically inactive, wedge shaped panel 150 that is mounted by its frame one or more cross beams to adjacent trusses 126, via tube clamps fixed to the cross beams and engaging tubes of the adjacent trusses that are of the box truss type.

Figure 5:
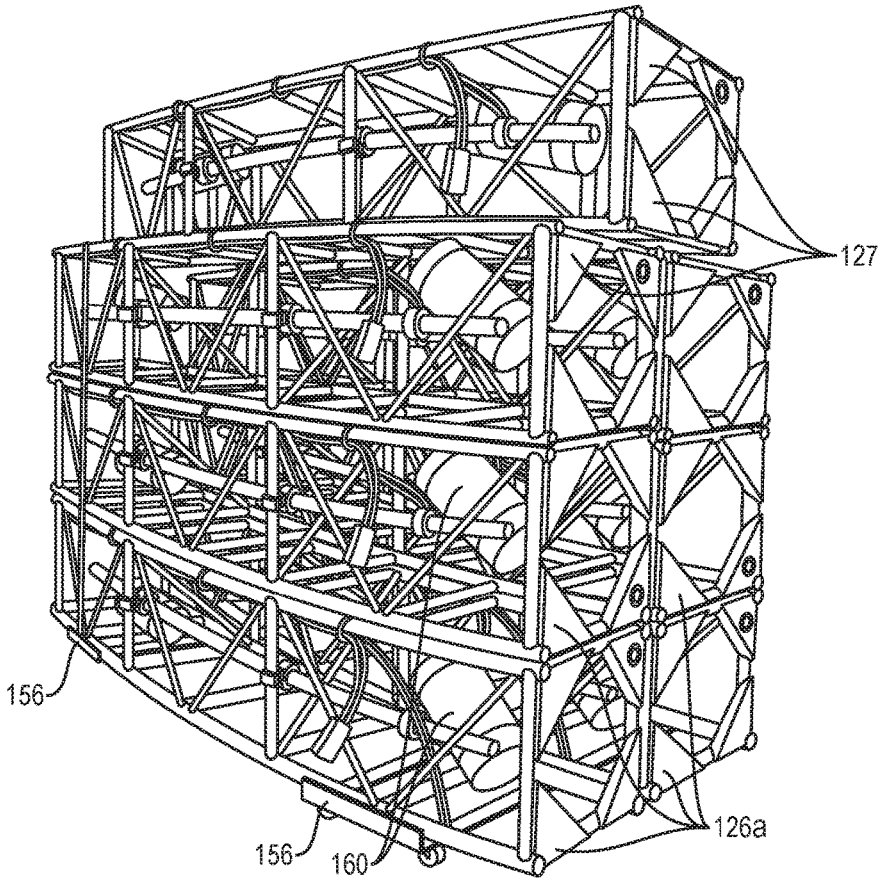
FIG. 5 is a rear perspective view of a transport cart with other components of the invention including seven lowest truss parts for the seven arches to be used in a preferred embodiment of the invention, these components also being securely strapped to the cart for transport from one venue to the next.

FIG. 5 illustrates the packaging, on two wheeled carriages 156 that make up a cart for this part of the invention, made up of seven bottom-most truss parts 126*a*, for each of the seven arches 126 of a preferred embodiment of the invention. In FIG. 1, nine arches 126 are shown and this embodiment can be used if it is desired to expand the width of the visual effect of the shell 100, but with no active or inactive panels added, since the desired acoustic effect is achieved with six sets of panels, although fewer or more sets of acoustic panels are within the scope of the invention.

FIG. 5 shows the seven truss parts 126*a*, strapped to the cart 156, 156 with recoverable straps, and also shows that one or more light cans 160 are mounted to each truss part. This automatically positions at least some of the needed stage lighting as the shell is erected. The multiple, in the preferred embodiment, four, truss parts of each arch 126 are connected, end to end, by nuts and bolts that extend through aligned holes in four gusset plates 127 provided at the four corners of each end of each box type truss part.

The seven lowest truss parts 126*a* are each curved and nest well on cart 156 for transport, and, with similar carts for the other truss parts, organize the assembly operation. For transportability, each truss part is from 6 to 12 feet long and in a preferred embodiment of the invention, four truss parts, each of the box truss type, are bolted together to form each arch 126 which creates a concave volume of 15 to 35 feet tall and 20 to 40 feet wide.

Figure 7:
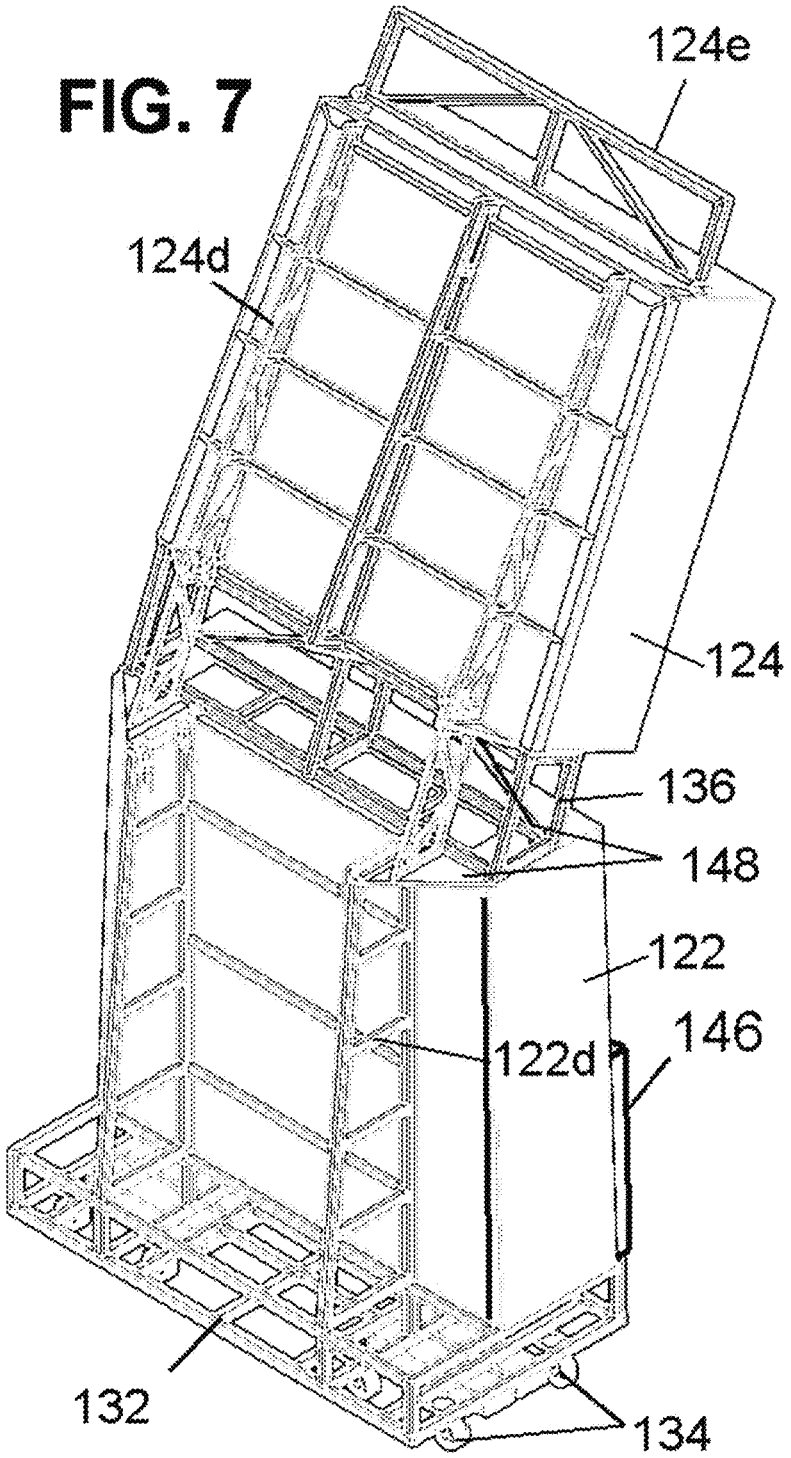
FIG. 7 is a rear perspective view of the upper and lower acoustic panels and connected wedge truss assembled.

FIGS. 6 and 7 illustrate details of the connection between the lower and upper acoustically active panels 122 and 124, the truss wedge 136, the gusset plates 148 with their mating projection and hole, as well as the frames 122*d* and 124*d*, of the active panels. FIG. 7 also illustrates the use of one flat tuning panel 146 of somewhat sound absorbing material that covers the lower half of one of the lower acoustic panels 122 to remove some of its diffusing effect. Two such panel can also be used to entirely cover a lower panel 122 or other panels can be selectively partly or entirely covered to fine tune the acoustic properties of the shell for a particular venue as needed.

Figure 8:
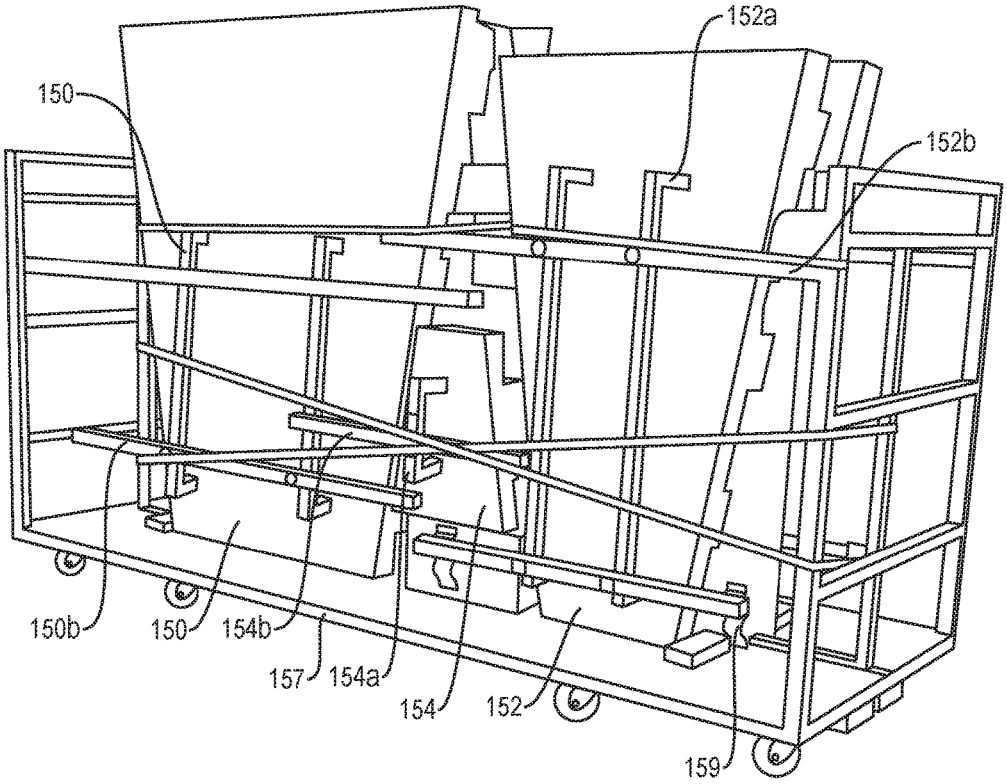
FIG. 8 is a rear perspective view of a transport cart with other components of the invention including six of the eighteen wedge shaped inactive, decorative panels to be mounted at the top of the frame, above the columns of acoustically active panels, these components also being securely strapped to a cart for transport from one venue to the next.

FIG. 8 illustrates a cart 157 with frame and straps for securing and transporting six of the eighteen inactive panels 150, 152 and 154 of the preferred embodiment of the invention. Each panel has a frame 150*a*, 152*a* and 154*a*, to which is connected one or two cross beams 150*b*, 152*b* and 154*b* for each panel. Tube clamps 159 are connected to the opposite ends of the upper, lower or only cross beam of each inactive panel, and act as temporary fasteners for fixing each inactive panel to the tubes of adjacent truss parts of the shell frame. For the larger panels 150 and 152 that have two cross beams, pads are provided on the other cross beam so that the weight of that panel bears down on the truss tube at a spaced location from the clamps 159 for that panel. In this way only one set of clamps need be connected for each inactive panel to save assembly time but without sacrificing structural integrity of the shell as a whole.

Figure 9:
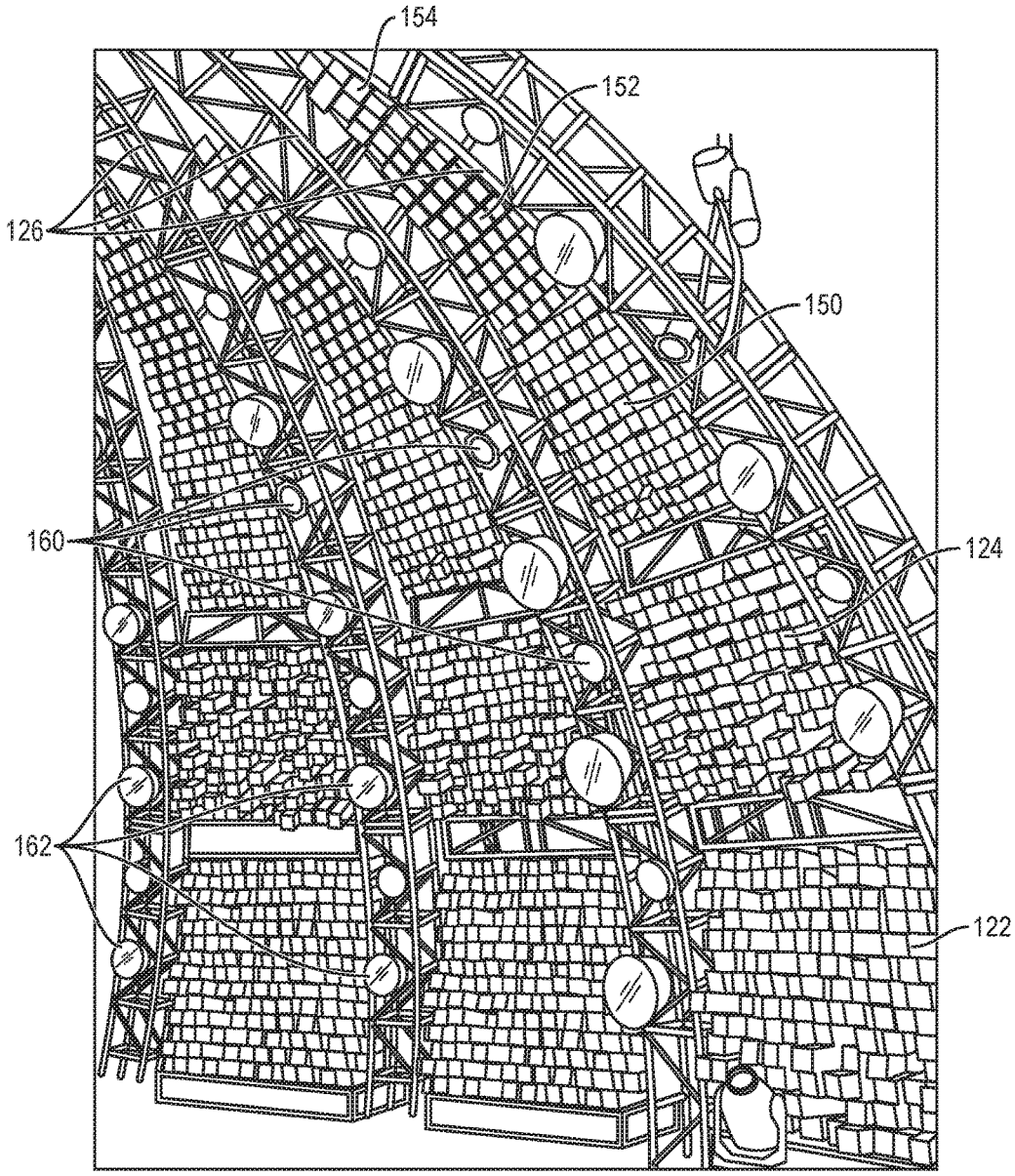
FIG. 9 is a partial front perspective view of all panels in three of the columns of panels, showing the two lower acoustically active quadrilateral panels and the three upper inactive wedge shaped panels.

FIG. 9 shows a section of the assembled shell 100, with three of the six panel columns in place between four of the seven arches 126. FIG. 9 also shows how additional light fixtures 162 can be hung on the arches. Although the lower and upper active acoustic panels 122 and 124 are not mechanically connected to their adjacent arches, the three inactive panels 150, 152 and 154 are, by being clamped to their adjacent arches. This helps stabilize the spacing between arches 126 without loading them with the considerable weight of the active panels. The inactive panels are made of molded foam and even with their frames and cross beams are much lighter than the acoustic panels.

Figure 10:
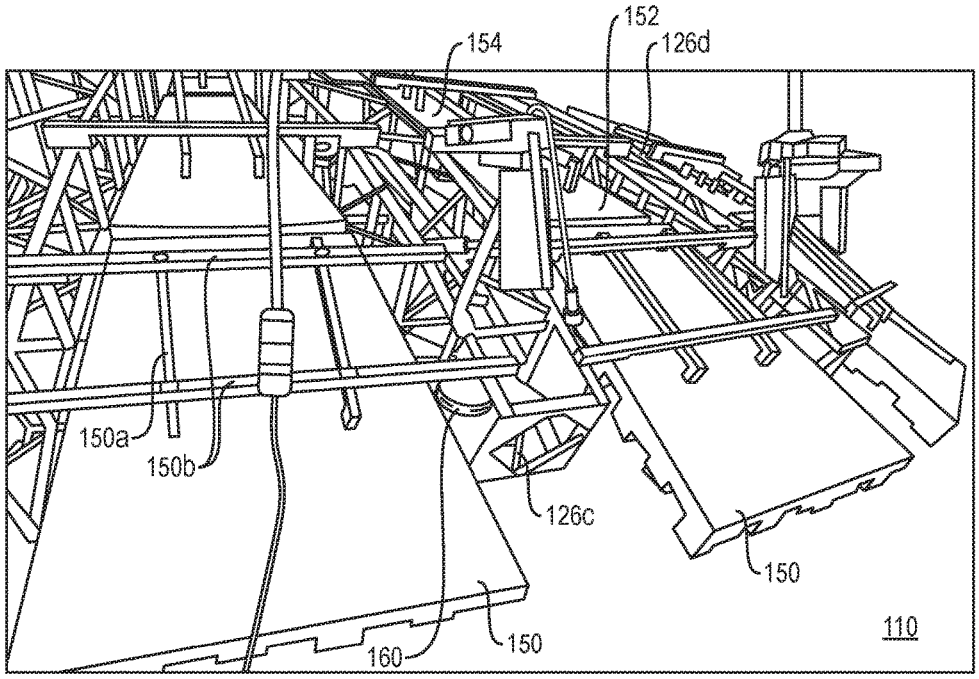
FIG. 10 is a partial perspective rear view of the partially assembled shell with inactive upper panels in place, clamped to adjacent arches of the frame.
Figure 11:
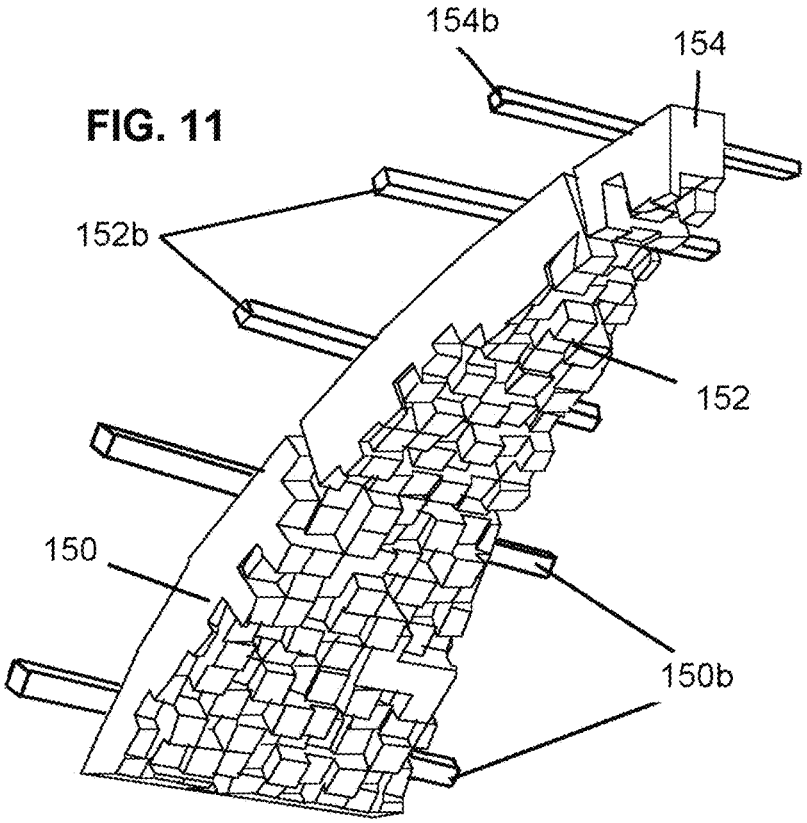
FIG. 11 is a front perspective view of three upper, inactive but visually consistent panels that complete the overall appearance of the shell.
Figure 13:
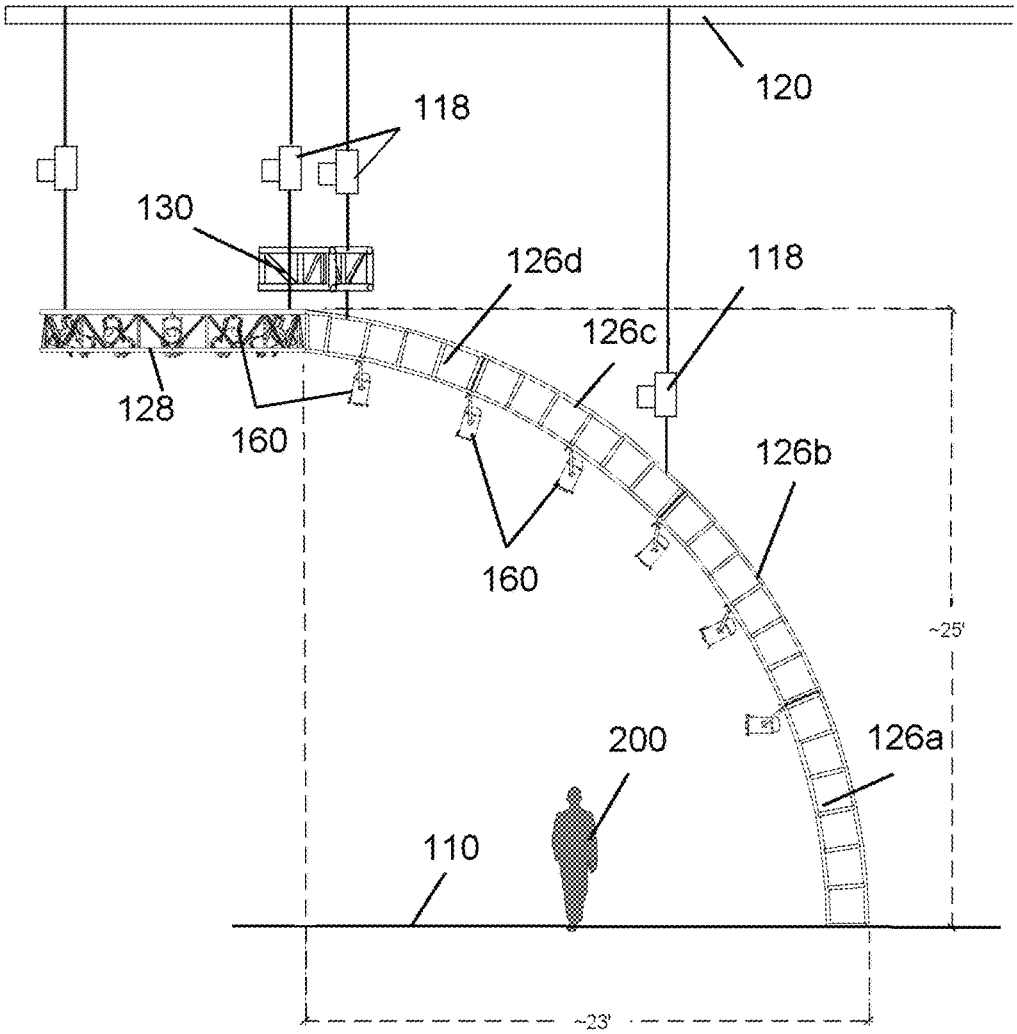
FIG. 13 is a side elevational view, partly in section, of one arch, the oculus, the C-shaped truss, which may be present or, in other embodiments of the invention, may not be needed, and rigging motors of the invention, in a venue setting for use of the invention.

FIG. 10 illustrates an intermediate condition of assembly of the invention after the upper two of the four truss parts, namely parts 126*d* and 126*c* have been removed from their carts and spread on the stage floor 110 around the also assembled the optional C-Shaped truss and the oculus. The two upper truss parts have been bolted together and their joint upper ends or peaks are flexibly fastened, e.g. by straps, at spaced locations around the oculus. With reference also to FIGS. 11, 12 and 13, using four of the rigging motors 118 having cables suspending them from the rigging grid above, the C-shaped truss 130, if used, is lift above the oculus 128, which is initially on the stage surface. With some clearance to work, the peaks of the seven partially completed arches are flexibly connected, e.g. by straps, to the bottom of the C-shaped truss 130. With these peaks also flexibly connected around part of the circumference of oculus 128, the four rigging motors 118 connect to the oculus and the four motor connected to the C-shape truss 130 are together lifted to about 10 feet above the stage surface to the position shown in FIG. 10.

In this partly assembled and raised position, the eighteen inactive but cosmetic panels 150, 152 and 154 in six rows, are manually lifted onto the partially completed frame and clamped in place using the tube clamps 159. Seven additional, grid suspended rigging motors 118 are then connected to lower ends of each truss part 126*c* and all fifteen attached rigging motors 118 are then activated together to lift the partial assembly high enough above the stage surface to bolt on the second truss parts 126*b* (see FIG. 13). This operation is repeated to bolt on each first and lowest truss part 126*a*, below the second truss parts to complete each arch 126. The bottom the each first truss part 126*a* rests on the stage surface and is held in place by friction.

FIG. 11 is a front perspective view of the three upper, wedge shaped, generally acoustically inactive, but visually consistent panels 150, 152 and 154, that complete the overall appearance of the shell by continuing the upper portion of each column of panels that each start at the bottom with the acoustically active panels 122 and 124. This continuity of appearance is important, as is evident from FIG. 1, to present the audience with an attractive consistent overall impression of the stage setting, while still taking advantage of the acoustic attributes of the lower two rows of panels.

The use of fifteen rigging motors that are typically rated for lifting 1 ton each, and oculus and the optional C-shaped truss, advantageously spreads the considerable weight of the combined arches and inactive panels, along with the pre-attached light cans, the added lights and associated wiring and switching equipment.

Once the arches 126 and their connected parts are erected, the upper acoustic panels 124 are hoisted by six additional grid-suspended rigging motors 118 so they just clear the stage surface sufficiently to attach each truss wedge 136. To prevent inadvertent damage to their relatively delicate acoustically active front block ends of the panel 124, this operation may be performed with these panels facing rearwardly away from the front concave volume of the shell. The panels 124 are then hoisted further and turned to face forwardly. The wagons 132 with lower most panels 122 are then rolled under the upper panels 122 and then, using the rigging motors to gently raise and lower the upper panel with wedge as needed, the lower panel is clamped to the lower end of the truss wedge for each panel column. The rigging motors keep upward tension on each set of acoustic panels 122, 124 throughout a performance to keep this forwardly cantilevered structure in place and limit the downward load of any one wagon wheel 134 on the stage surface.

Figure 14:
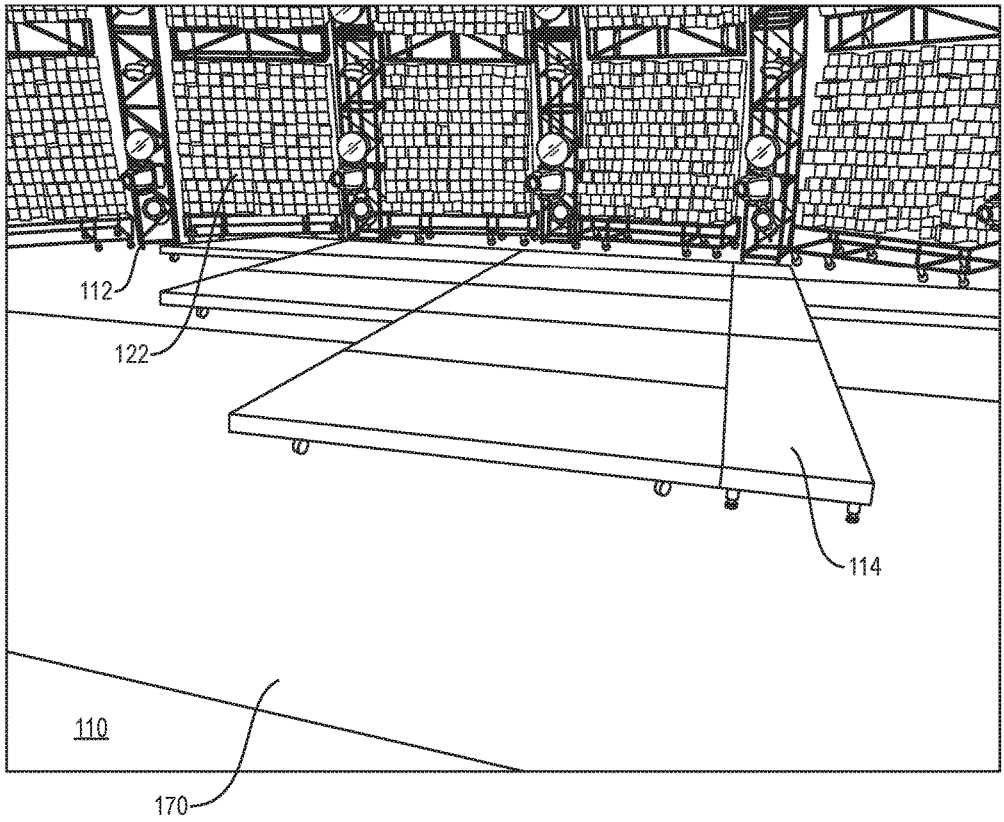
FIG. 14 is a partial perspective rear view of the acoustically active floor of one embodiment of the invention.

FIG. 14 shows one of many acoustically active, i.e. sound absorbing, floors that are used in conjunction with the frame and panel columns to enhance the acoustic attributes of the shell 100 and provide a repeatable acoustic environment by any performance venue. In order to make the floor portable, mechanically linked, preferable 4 foot by 8 foot sections and some sections with angled sides are assembles in any configuration to cover a selection area of the stage surface. In FIG. 14 a T-shaped pattern is created having a forward area covered by a thick wool rug 170. Natural wool has been found to be a better sound absorber than synthetic fabric rugs. Each floor panel is a double thickness of wood or fiberboard, backed by sound absorbing batting and wool rug covered. FIG. 12 illustrates another configuration for the acoustically active floor 114.

With the help of the rigging motors, the assembly operation is reversed to disassembly the shell and strap its components to the transport carts which are rolled onto an appropriate number of transport trucks to be driven to the next venue for setup.

FIG. 15 is a schematic front elevation of a typical acoustically active panel 122 or 124 of the invention with the numbers indicating the length of each block in inches.

While specific embodiments of the invention have been shown and described in detail to illustrate the application of the principles of the invention, it will be understood that the invention may be embodied otherwise without departing from such principles.

What is claimed is:

1. An acoustic shell for stage performances comprising:

a frame defining a concave volume that is curved in two orthogonal planes and has an inner surface for facing forwardly of a stage for a performance on which the shell is it to be erected;

a plurality of polygonal acoustic panels positioned in the frame and spaced in rows and column along the inner surface, each acoustic panel having an inner acoustically active surface;

the frame comprising a plurality curved arches each with a base to be in contact with the stage, and a peak, the bases being spaced along a bottom curve of the concave volume and each column of acoustic panels being disposed between adjacent arches of the frame;

an oculus ring flexibly connected to the peaks of the arches;

each acoustic panel comprising a plurality of adjacent blocks in rows and columns, each block having a base at a common outer plane and an inner closed end, the length of each block from its base to its inner closed end being different for adjacent blocks so as to diffuse sound sticking the acoustically active surface; and wherein each arch comprises a curved, multi part truss extending about one quarter of a circle, the oculus ring comprising a truss ring extending in a full circle and the shell including a C-shaped truss above the oculus ring and the peaks of the arches, the C-shaped truss being flexibly connected to at least some of the arches.

2. An acoustic shell for stage performances comprising:

a frame defining a concave volume that is curved in two orthogonal planes and has an inner surface for facing forwardly of a stage for a performance on which the shell is it to be erected;

a plurality of polygonal acoustic panels positioned in the frame and spaced in rows and column along the inner surface, each acoustic panel having an inner acoustically active surface;

the frame comprising a plurality curved arches each with a base to be in contact with the stage, and a peak, the bases being spaced along a bottom curve of the concave volume and each column of acoustic panels being disposed between adjacent arches of the frame; and an oculus ring flexibly connected to the peaks of the arches;

each acoustic panel comprising a plurality of adjacent blocks in rows and columns, each block having a base at a common outer plane and an inner closed end, the length of each block from its base to its inner closed end being different for adjacent blocks so as to diffuse sound sticking the acoustically active surface, each block of each acoustic panel comprising a hollow block with a closed base and sound absorbing batting in each block.

3. The acoustic shell of claim 2, wherein the inner closed end of at least some of the blocks extends at a non-zero acute angle to the outer common plane of its acoustic panel.

4. The acoustic shell of claim 2, wherein the inner closed end of at least some of the blocks extends at a non-zero acute angle to the outer common plane of its acoustic panel, each block of each acoustic panel comprising a hollow block of fiberboard with the closed base and sound absorbing batting in each block.

5. An acoustic shell for stage performances comprising:

a frame defining a concave volume that is curved in two orthogonal planes and has an inner surface for facing forwardly of a stage for a performance on which the shell is it to be erected;

a plurality of polygonal acoustic panels positioned in the frame and spaced in rows and column along the inner surface, each acoustic panel having an inner acoustically active surface;

the frame comprising a plurality curved arches each with a base to be in contact with the stage, and a peak, the bases being spaced along a bottom curve of the concave volume and each column of acoustic panels being disposed between adjacent arches of the frame;

an oculus ring flexibly connected to the peaks of the arches;

each acoustic panel comprising a plurality of adjacent blocks in rows and columns, each block having a base at a common outer plane and an inner closed end, the length of each block from its base to its inner closed end being different for adjacent blocks so as to diffuse sound sticking the acoustically active surface; and a wheeled wagon connected to and supporting at least some of the weight of the lower-most acoustic panel of each column of panels.

6. The acoustic shell of claim 5, including a plurality of decorative panels between upper ends of adjacent ones of the curved arches in the frame, each decorative panel simulating the appearance of the acoustically active surface of the acoustic panels and being above one column of the acoustic panels.

7. The acoustic shell of claim 5, including a plurality of decorative wedge shaped panels clamped between upper ends of adjacent ones of the curved arches, each decorative panel simulating the appearance of the acoustic panels and being above one column of the acoustic panels, each wheeled wagon having at least two locking wheels for fixing the positions of the lowest acoustic panels between adjacent arches during a performance.

8. The acoustic shell of claim 5, wherein each block of each acoustic panel comprises a hollow block of medium-density fiberboard, with a closed base and sound absorbing batting of mineral wool in each block.

9. An acoustic shell for stage performances comprising:

a frame defining a concave volume that is curved in two orthogonal planes and has an inner surface for facing forwardly of a stage for a performance on which the shell is it to be erected;

a plurality of polygonal acoustic panels positioned in the frame and spaced in rows and column along the inner surface, each acoustic panel having an inner acoustically active surface;

the frame comprising a plurality curved arches each with a base to be in contact with the stage, and a peak, the bases being spaced along a bottom curve of the concave volume and each column of acoustic panels being disposed between adjacent arches of the frame;

an oculus ring flexibly connected to the peaks of the arches;

each acoustic panel comprising a plurality of adjacent blocks in rows and columns, each block having a base at a common outer plane and an inner closed end, the length of each block from its base to its inner closed end being different for adjacent blocks so as to diffuse sound sticking the acoustically active surface;

each arch comprising a curved multi-part truss extending about one quarter of a circle, the oculus ring comprising a truss ring extending a full circle; and a plurality of rigging motors connected to the arches and to the oculus for supporting at least some of the weight of the shell.

10. The acoustic shell of claim 9, including a plurality of decorative wedge shaped panels between upper ends of adjacent ones of the curved arches, each decorative panel simulating the appearance of the acoustic panels and being above one column of the acoustic panels.

11. The acoustic shell of claim 9, wherein the inner closed end of at least some of the blocks extends at an angle of about 10 to 20 degrees to the outer common plane of its acoustic panel.

12. The acoustic shell of claim 9, wherein the inner closed end of at least some of the blocks extends at an angle of about 15 degrees to the outer common plane of its acoustic panel.

13. The acoustic shell of claim 9, wherein each block of each acoustic panel comprises a hollow block of fiberboard, with a closed base and sound absorbing batting of rock wool in each block.

14. The acoustic shell of claim 9, including a C-shaped truss above the oculus, each arch comprising a curved multi-part truss extending about one quarter of a circle, the oculus ring comprising a truss ring extending a full circle, the C-shapes truss being flexibly connected near the top of a least some of the arches, and a plurality of rigging motors connected to the arches, to the C-shaped truss and to the oculus for lifting and supporting at least some of the weight of the shell.

15. An acoustic shell for stage performances comprising:

a frame defining a concave volume that is curved in two orthogonal planes and has an inner surface for facing forwardly of a stage for a performance on which the shell is it to be erected;

a plurality of polygonal acoustic panels positioned in the frame and spaced in rows and column along the inner surface, each acoustic panel having an inner acoustically active surface;

the frame comprising a plurality curved arches each with a base to be in contact with the stage, and a peak, the bases being spaced along a bottom curve of the concave volume and each column of acoustic panels being disposed between adjacent arches of the frame;

an oculus ring flexibly connected to the peaks of the arches;

each acoustic panel comprising a plurality of adjacent blocks in rows and columns, each block having a base at a common outer plane and an inner closed end, the length of each block from its base to its inner closed end being different for adjacent blocks so as to diffuse sound sticking the acoustically active surface; and a plurality of rigging motors connected to a rigging grid above the stage and to the arches and to the oculus for supporting at least some of the weight of the shell.

16. The acoustic shell of claim 15, including a wagon with at least one lockable wheel on which the lowest acoustic panel in each column is supported, an upper acoustic panel above the lowest acoustic panel in each column being fixed to the lowest acoustic panel in the same column by temporary fasteners.

17. The acoustic shell of claim 15, including a wagon with at least one lockable wheel on which the lowest acoustic panel in each column is supported, a truss wedge connected by temporary fasteners to an upper end of the lowest acoustic panel, an upper acoustic panel above the lowest acoustic panel in each column being fixed to the truss wedge by temporary fasteners.

18. An acoustic shell for stage performances comprising:

a frame defining a concave volume that is curved in two orthogonal planes and has an inner surface for facing forwardly of a stage for a performance on which the shell is it to be erected;

a plurality of polygonal acoustic panels positioned in the frame and spaced in rows and column along the inner surface, each acoustic panel having an inner acoustically active surface;

the frame comprising a plurality curved arches each with a base to be in contact with the stage, and a peak, the bases being spaced along a bottom curve of the concave volume and each column of acoustic panels being disposed between adjacent arches of the frame; and an oculus ring flexibly connected to the peaks of the arches;

each acoustic panel comprising a plurality of adjacent blocks in rows and columns, each block having a base at a common outer plane and an inner closed end, the length of each block from its base to its inner closed end being different for adjacent blocks so as to diffuse sound sticking the acoustically active surface; and wherein each arch comprises a plurality of curved box truss sections connected end to end to each other by temporary fasteners, and together extending about one quarter of a circle from the stage to the oculus.

19. The acoustic shell of claim 18, each truss section including at least one stage light.

20. The acoustic shell of claim 18, including a flooring arrangement on the stage and at least partly in the concave volume, the flooring arrangement having selection acoustic properties for absorbing sound.

21. The acoustic shell of claim 18, including a flooring arrangement on the stage and at least partly in the concave volume, the flooring arrangement having selection acoustic properties for absorbing sound, the flooring arrangement comprising a plurality of separate floor sections connected to each other by temporary fasteners.

22. An acoustic shell for stage performances comprising:

a frame defining a concave volume that is curved in two orthogonal planes and has an inner surface for facing forwardly of a stage for a performance on which the shell is it to be erected;

a plurality of polygonal acoustic panels positioned in the frame and spaced in rows and column along the inner surface, each acoustic panel having an inner acoustically active surface;

the frame comprising a plurality curved arches each with a base to be in contact with the stage, and a peak, the bases being spaced along a bottom curve of the concave volume and each column of acoustic panels being disposed between adjacent arches of the frame;

an oculus ring flexibly connected to the peaks of the arches;

each acoustic panel comprising a plurality of adjacent blocks in rows and columns, each block having a base at a common outer plane and an inner closed end, the length of each block from its base to its inner closed end being different for adjacent blocks so as to diffuse sound sticking the acoustically active surface; and a plurality of acoustically inactive wedge shaped panels connected by temporary fasteners between upper ends of adjacent ones of the curved arches, each inactive panel simulating the appearance of the acoustic panels and being above one column of the acoustic panels, the acoustic panels being positioned between but not connected to lower ends of adjacent ones of the curved arches.

23. The acoustic shell of claim 22, including a plurality of rigging motors adapted to be suspended from a rigging grid above the stage and connected to the oculus, the arches and the acoustic panels for supporting at least some of the weight of the shell.

24. The acoustic shell of claim 22, including a sound absorbing floor supported on the stage and at least partly within the concave volume, a C-shaped truss connected to upper ends of each arch, plurality of rigging motors adapted to be suspended from a rigging grid above the stage and connected to the oculus, the C-shaped support, the arches and the acoustic panels for supporting at least some of the weight of the shell.

25. The acoustic shell of claim 22, including a sound absorbing floor supported on the stage and at least partly within the concave volume, a C-shaped truss connected to upper ends of each arch, plurality of rigging motors adapted to be suspended from a rigging grid above the stage and connected to the oculus, the C-shaped support, the arches and the acoustic panels for supporting at least some of the weight of the shell, and a flooring arrangement on the stage and at least partly in the concave volume, the flooring arrangement having selection acoustic properties for absorbing sound.

26. The acoustic shell of claim 22, including at least one tuning board for covering at least part of at least one acoustic panel for fine tuning the acoustic properties of the shell.

* * * * *